United States Patent [19]

Sprague et al.

[11] 3,966,429

[45] June 29, 1976

[54] MANGANESE CONTAINING FUELS

[75] Inventors: James W. Sprague, Bedford; Daniel W. Feldman, Beachwood; Frank Veatch, Cleveland, all of Ohio

[73] Assignee: Standard Oil Company, Cleveland, Ohio

[22] Filed: May 16, 1974

[21] Appl. No.: 470,692

[52] U.S. Cl. ..... 44/68; 44/70

[51] Int. Cl.[2] ..... C10L 1/18

[58] Field of Search ..... 44/68, 70; 260/429.7

[56] References Cited

UNITED STATES PATENTS

| | | | |
|---|---|---|---|
| 1,995,615 | 3/1935 | Jaeger | 44/70 |
| 2,898,354 | 8/1959 | Shapiro et al. | 44/68 |
| 2,948,744 | 8/1960 | Hnizda | 44/68 |
| 3,397,969 | 8/1968 | Tooke | 44/68 |

*Primary Examiner*—Daniel E. Wyman
*Assistant Examiner*—Y. Harris-Smith
*Attorney, Agent, or Firm*—Herbert D. Knudsen

[57] ABSTRACT

Gasoline compositions containing manganese additives are improved by the addition of either a citrate compound having at least one alkyl group or a tetravalent tin compound having at least one alkyl group, both of which compounds must be soluble in gasoline and are added to the gasoline composition to improve the performance of the engine.

12 Claims, No Drawings

MANGANESE CONTAINING FUELS

BACKGROUND OF THE INVENTION

It is well known that lead gasoline additives have been under attack due to environmental reasons. As a result, there has been a search for suitable octane improvers that do not employ lead. Various manganese compounds have been found and are known to improve the octane rating of gasoline compositions.

Discovery of these new manganese additives has presented additional problems in that now compatible additives must be found which alleviate problems caused by the use of manganese.

One problem encountered with the use of manganese additives is spark plug gap bridging and the resultant misfiring and engine malfunction. Another problem arises from the use of gasoline containing both manganese and lead additives. This combination results in deposits on the exhaust valve that reduce compression pressure and lead to engine malfunction due to burned exhaust valves.

SUMMARY OF THE INVENTION

It has now been discovered that these problems of the art can be solved by the addition of a citrate compound for spark plug misfiring or a tetravalent tin compound for undesirable valve deposits. More specifically, the invention is a gasoline composition for combustion in a gasoline internal combustion engine comprising gasoline, a gasoline soluble manganese compound as an additive and a small but effective amount of a citrate compound having at least one alkyl group or a tetravalent tin compound having at least one alkyl group, each of said compounds being soluble in gasoline and acting as a gasoline additive to improve the performance of the gasoline internal combustion engine.

The base fuel employed in the invention is gasoline containing a suitable manganese additive. The gasoline compositions employed in this fuel are well known in the art. The manganese compounds although less well known are readily available on a commercial basis. Suitable manganese compounds have been invented and publicized by various companies especially the Ethyl Corporation. One of the most prominent of the manganese additives is methylcyclopentadienyl manganese tricarbonyl. Use of this additive in the base fuel of the present invention is especially preferred.

The present invention is the incorporation of either an alkyl tin compound or an alkyl citrate compound into these manganese base fuels. The alkyl tin compound in our experiments showed the ability to substantially reduce the deposits in the valve closures and the alkyl citrate compounds substantially reduced the misfirings of the internal combustion engines.

The alkyl citrate compounds employed in the present invention may vary widely. Broadly these alkyl citrate compounds are citrates that contain at least one alkyl group. Preferred citrates are those that contain three alkyl groups of about 2 to 4 carbon atoms. The alkyl citrate must be soluble in the manganese gasoline composition and it must be present in the manganese composition in a concentration that improves the performance of the internal combustion engine. From our experience, primarily related to the use of triethyl citrate, suitable concentrations range from about 10 to about 180 milligrams of triethyl citrate per gallon. For other citrates, the concentration could be determined from these usages of triethyl citrate.

The tetravalent tin compound having at least one alkyl group may also vary widely. This additive may be employed alone or in combination with the citrate additive. Preferred is the use of this additive in combination with the citrate additive. Also preferred are the tetraalkyl tin compounds, especially those tetraalkyl tin compounds that have alkyl groups of 3–6 carbon atoms each. The alkyl tin compound must also be soluble in the manganese containing composition and this tin additive should be present in concentrations that substantially reduces the valve deposits. Suitable ranges of concentrations for the tin additive range from about 10 to about 75 milligrams of tin per gallon calculated on the tin rather than the total weight of the alkyl tin compound. These concentrations are based on our experiments with tetra butyl tin and can be adjusted appropriately for other tin compounds.

In addition to the additives specifically required by the present invention, the gasoline compositions encompassed by the invention would include other additives that are known and developed which would not interfere with the functions of the additives of the invention. Thus, for example, in addition to the manganese additive and the tin compound or the citrate, suitable inhibitors or other additives could be employed.

SPECIFIC EMBODIMENTS

All examples of the present invention were run using a base fuel having an initial octane rating of about 93 R.O.N. To this fuel was added 0.2 grams per gallon of manganese as methylcyclopentadienyl manganese tricarbonyl. In addition, the fuel contained 340 p.p.m. Oronite OGA-472 and ⅛ of one percent SEB-78. This fuel exhibited a 96 R.O.N. To represent a lead contaminated fuel, 0.5 grams per gallon of lead, as tetra ethyl lead, was added to this manganese fuel.

All experiments were run on a Kohler K91 engine. This engine was rated at 4 horsepower and has a single cylinder of cast iron. For evaluating resistance to misfiring, the engine was run at 3600 rpm with no added load except for an integral cooling fan. For the tests, an extended core plug of moderately high heat range was selected. This plug has a designation from AC of AC465. The heat range was suitable for turnpike as well as around-town driving conditions. The extended core was chosen to increase the test severity by exposing the plug to more of the products of combustion. To further increase the severity of the test, the electrode gap was reduced to 0.015 inches. These severe conditions were chosen to obtain the most informative test results in the shortest period of time. The results of these experiments were later confirmed on full-size automobile engines.

Each of the tests was run with a clear freshly set plug which would give reliable ignition. Each test was begun with fresh oil and a clean combustion chamber. The engine was run for a period of 19 hours to provide adequate plug deposits. Then for a period of one hour, the number of misfires were counted. In some cases, the engine stalled before a misfire count could be made. To detect misfire, the exhaust line pressure near the exhaust port was monitored with a Kistler pressure pickup. The exhaust line pressure depended on the ignition success of the plug. When a misfire occurred, a counter recorded the misfire.

For the exhaust valve seal test, the engine was loaded with a blower that absorbed 1.5 horsepower at 3600 rpm. That load was 40% of the rated engine power at the speed. The test was run for 24 hours, using a fuel composition containing lead as described above.

EXAMPLE 1

Effect of Triethyl Citrate on the Number of Misfires.

The manganese fuel described above was run in the Kohler engine. It was determined that the citrate compound improved the ignition reliability of the manganese fuel. Instances of premature stalling and misfire counts in the 20th hour of 13,000 were improved to no instances of stalling and misfire counts of 2000 or less using triethyl citrate concentrations of between 20 and 160 milligrams per gallon. Equally favorable results were obtained with fuel containing both triethyl citrate and tetrabutyl tin.

EXAMPLE 2

Effect of Triethyl Citrate on Plug Gap Deposits.

The spark plugs used with the manganese fuel were examined. Deposits appeared to form on the plug electrodes as needles, extending from the center electrode towards the ground electrode. Occasionally, such needles bridged the gap completely, causing the plug to be shorted out. However, with triethyl citrate incorporated in the fuel at a level of 40 milligrams per gallon, the growth of these deposits was substantially eliminated.

EXAMPLE 3

Effect of Tetrabutyl Tin on Valve Seal Deposits.

The leaded manganese fuel described above was run in the Kohler engine. A substantial deposit accumulated on the exhaust valve and seat which resulted in a broadened contact in local areas, interfering with the valve seal. With 20 milligrams per gallon of tin as tetra-n-butyl tin, the deposits on the valve closure were very much smaller and thinner and there was no damage to the valve seal. Similar favorable results were obtained using a fuel containing both tetra butyl tin and triethyl citrate.

In the same way as shown in the examples above, triethyl citrate could be replaced by tripropyl or tributyl citrate and the benefits of the invention realized. Also in the same manner, the tetrabutyl tin could be substituted by dibutyl tin dichloride, dibutyl tin diacetate, dibutyl tin Di-2 ethylhexoate or dibutyl tin dilaurate also giving the desirable results of the invention in the reduction of the deposits.

These additives are economically feasible from the cost standpoint and are not toxic to the extent that they would be precluded as gasoline additives. Above all, they are very desirable additives for gasoline containing manganese.

We claim:

1. In a gasoline composition for combustion in a gasoline internal combustion engine comprising gasoline and a gasoline soluble manganese tricarbonyl compound as an additive, the improvement comprising including a small but effective amount of a trialkyl citrate compound, said compound being soluble in gasoline and acting as a gasoline additive to improve the performance of the gasoline internal combustion engine.

2. The composition of claim 1 wherein the trialkyl citrate has an alkyl group of 2–4 carbon atoms.

3. The composition of claim 1 wherein the trialkyl citrate is triethyl citrate.

4. The composition of claim 1 wherein the manganese tricarbonyl compound is methylcyclopentadienyl manganese tricarbonyl.

5. A gasoline composition for combustion in a gasoline internal combustion engine comprising gasoline and a gasoline soluble manganese tricarbonyl compound as an additive, the improvement comprising including a small but effective amount of a tetraalkyl tin compound said compound being soluble in gasoline and acting as a gasoline additive to improve the performance of the gasoline internal combustion engine.

6. The composition of claim 5 wherein the tetraalkyl tin compound has alkyl groups of about 3 to about 6 carbon atoms.

7. The composition of claim 5 wherein the tetraalkyl tin compound is tetrabutyl tin.

8. The composition of claim 5 wherein the manganese tricarbonyl compound is methylcyclopentadienyl manganese tricarbonyl.

9. The composition of claim 5 containing a gasoline soluble trialkyl citrate compound.

10. The gasoline composition of claim 3 wherein the concentration of the triethyl citrate is 10 to 180 milligrams per gallon of gasoline.

11. The gasoline of claim 1 containing methylcyclopentadienyl manganese tricarbonyl and triethyl citrate.

12. The gasoline of claim 5 containing about 10 to 75 milligrams of tetraalkyl tin per gallon of gasoline calculated on the weight of the tin.

* * * * *